US005599439A

United States Patent [19]

Collins et al.

[11] Patent Number: 5,599,439

[45] Date of Patent: Feb. 4, 1997

[54] GASOLINE AND REFORMATE UPGRADING PROCESS

[75] Inventors: Nick A. Collins, Medford, N.J.; Mohsen N. Harandi, Langhorne, Pa.; Edward F. Kondis, Marshall, Va.; Hartley Owen, Worton, Md.

[73] Assignee: Mobil Oil Corporation, Fairfax, Va.

[21] Appl. No.: 322,466

[22] Filed: Oct. 14, 1994

Related U.S. Application Data

[63] Continuation of Ser. No. 31,446, Mar. 13, 1993, abandoned.

[51] Int. Cl.[6] ..... C10G 45/00; C10G 69/00

[52] U.S. Cl. ..... 208/89; 208/212

[58] Field of Search ..... 208/89, 212

[56] References Cited

U.S. PATENT DOCUMENTS

| | | | |
|---|---|---|---|
| 3,625,880 | 12/1971 | Hamner | 208/111 |
| 3,729,409 | 4/1973 | Chen | 208/135 |
| 3,751,506 | 8/1973 | Burress | 260/671 R |
| 3,759,821 | 9/1973 | Brennan et al. | 208/93 |
| 3,763,034 | 10/1973 | Ketl et al. | 208/78 |
| 3,767,568 | 10/1973 | Chen | 208/134 |
| 3,845,150 | 10/1974 | Yan et al. | 260/673.5 |
| 3,923,641 | 12/1975 | Morrison | 208/111 |
| 3,957,625 | 5/1976 | Orkin | 208/211 |
| 4,016,218 | 4/1977 | Hoag et al. | 260/671 R |
| 4,049,542 | 9/1977 | Gibson | 208/213 |
| 4,062,762 | 12/1977 | Howard | 208/211 |
| 4,150,062 | 4/1979 | Garwood et al. | 260/673 |
| 4,209,383 | 6/1980 | Herout et al. | 208/93 |
| 4,358,363 | 11/1982 | Smith | 208/91 |
| 4,738,766 | 4/1988 | Fischer | 208/68 |
| 4,753,720 | 6/1988 | Morrison | 208/135 |
| 4,810,355 | 3/1989 | Hopkins | 208/58 |
| 4,827,069 | 5/1989 | Kushnerick et al. | 585/415 |
| 4,827,076 | 5/1989 | Kokayeff | 208/212 |
| 4,879,424 | 11/1989 | Harandi et al. | 585/322 |
| 4,997,543 | 3/1991 | Harandi et al. | 208/49 |
| 5,043,525 | 8/1991 | Haizmann et al. | 585/737 |
| 5,143,596 | 9/1992 | Maxwell et al. | 208/89 |

OTHER PUBLICATIONS

Handbook of Petroleum Refering, Robert A. Myers 1976 pp. 5–17–5–25.

*Primary Examiner*—Helane Myers

*Attorney, Agent, or Firm*—Dennis P. Santini; Jessica M. Sinnott

[57] ABSTRACT

A low sulfur gasoline of relatively high octane number is produced from a catalytically cracked, sulfur-containing naphtha by hydrodesulfurization followed by octane enhancing treatment in a fluidized bed catalytic process, in the presence of an aromatics-rich feedstream. The process converts the hydrodesulfurized intermediate and the aromatics-rich feedstream to a gasoline boiling range fraction of high octane number. The fluidized bed catalytic process is carried out over zeolite catalyst particles in a turbulent reactor bed at a temperature of about 600° to 800° F. (316° to 427° C.) and pressure of about 100 to 250 psig (790 to 825 kPa. The catalyst has an apparent particle density of about 0.9 to 1.6 g/cm$^3$ and a size range of about 1 to 150 microns, and average catalyst particle size of about 20 to 100 microns containing about 10 to 25 weight percent of fine particles having a particle size less than 32 microns. The feed vapor is passed upwardly through the fluidized catalyst bed under turbulent flow conditions; turbulent fluidized bed conditions are maintained through the reactor bed between transition velocity and transport velocity at a superficial fluid velocity of about 0.3 to 2 meters per second. Treatment in the fluidized bed catalytic process restores the octane loss which takes place as a result of the hydrogenative treatment and results in a low sulfur gasoline product with an octane number comparable to that of the feed naphtha.

19 Claims, 2 Drawing Sheets

GASOLINE AND REFORMATE UPGRADING PROCESS

This is a continuation of application Ser. No. 08/031,446, filed on Mar. 13, 1993, now abandoned.

FIELD OF THE INVENTION

This invention relates to a process for the upgrading of hydrocarbon streams. It more particularly refers to a process for upgrading gasoline boiling range petroleum fractions containing substantial proportions of sulfur impurities. Still more particularly, this invention integrates catalytic hydrotreating with hydrocarbon upgrading in a turbulent fluidized bed catalyst reactor to remove sulfur from a sulfur-containing fraction while maintaining, and perhaps enhancing, the octane of the feed.

BACKGROUND OF THE INVENTION

Catalytically cracked gasoline currently forms a major part of the gasoline product pool in the United States and it provides a large proportion of the sulfur in the gasoline. The sulfur impurities may require removal, usually by hydrotreating, in order to comply with product specifications or to ensure compliance with environmental regulations, both of which are expected to become more stringent in the future, possibly permitting no more than about 300 ppmw sulfur in motor gasolines; low sulfur levels result in reduced emissions of CO, $NO_x$ and hydrocarbons.

Naphthas and other light fractions such as heavy cracked gasoline may be hydrotreated by passing the feed over a hydrotreating catalyst at elevated temperature and somewhat elevated pressure in a hydrogen atmosphere. One suitable family of catalysts which has been widely used for this service is a combination of a Group VIII and a Group VI element, such as cobalt and molybdenum, on a substrate such as alumina. After the hydrotreating operation is complete, the product may be fractionated, or simply flashed, to release the hydrogen sulfide and collect the now sweetened gasoline.

Cracked naphtha, as it comes from the catalytic cracker and without any further treatments, such as purifying operations, has a relatively high octane number as a result of the presence of olefinic components. In some cases, this fraction may contribute as much as up to half the gasoline in the refinery pool, together with a significant contribution to product octane.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Various proposals have been made for removing sulfur while retaining the more desirable olefins. The sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

U.S. Pat. No. 4,049,542 (Gibson) discloses a process in which a copper catalyst is used to desulfurize an olefinic hydrocarbon feed such as catalytically cracked light naphtha. This catalyst is stated to promote desulfurization while retaining the olefins and their contribution to product octane.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Processes for improving the octane rating of catalytically cracked gasolines have been proposed. U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

The octane rating of the gasoline pool may be increased by other methods, of which reforming is one of the most common. Light and full range naphthas can contribute substantial volume to the gasoline pool, but they do not generally contribute significantly to higher octane values without reforming. They may, however, be subjected to catalytic reforming so as to increase their octane numbers by converting at least a portion of the paraffins and cycloparaffins in them to aromatics. Fractions to be fed to catalytic reforming, for example, with a platinum type catalyst, need to be desulfurized before reforming because reforming catalysts are generally not sulfur tolerant; they are usually pretreated by hydrotreating to reduce their sulfur content before reforming. The octane rating of reformate may be increased further by processes such as those described in U.S. Pat. No. 3,767,568 and U.S. Pat. No. 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components.

In applications Ser. Nos. 07/850,106, filed March 1992 pending, Ser. No. 07/745,311, filed Aug. 15 1991 pending, a process for the upgrading of gasoline by sequential hydrotreating and selective cracking stages is described. In the first stage of the process, the naphtha is desulfurized by hydrotreating and during this stage some loss of octane results from the saturation of olefins. The octane loss is restored in the second stage by a shape-selective cracking process carried out in the presence of an intermediate pore size zeolite such as ZSM-5. The product is a low-sulfur gasoline of good octane rating. Reference is made to Ser. Nos. 07/735,311 and 07/850,106 both pending for a detailed description of these processes.

A fluidized bed catalytic process for converting light olefinic gas and catalytic reformate feedstock to produce $C_7$–$C_{11}$ aromatic hydrocarbons is described in U.S. Pat. No. 4,827,069, which is incorporated herein by reference. The process converts the combined light olefinic gas and reformate to a heavier hydrocarbon product of higher octane value.

U.S. Pat. No. 4,150,062 (Garwood et al) discloses a process for the conversion of C2 to C4 olefins to produce gasoline which comprises contacting the olefins with water over a zeolite catalyst. U.S. Pat. No. 4,016,218 (Haag et al) and U.S. Pat. No. 3,751,506 (Burress) disclose processes for the alkylation of benzene with olefins over a ZSM-5 type catalyst. U.S. Pat. No. 4,209,383 (Herout et al) discloses the catalytic alkylation of benzene in reformate with C3–C4 olefins to produce gasoline.

SUMMARY OF THE INVENTION

We have developed a process for restoring the octane of a hydrodesulfurized gasoline while simultaneously reducing the benzene concentration of an aromatics-rich hydrocarbon fraction and converting light olefinic gas to a heavier hydrocarbon product.

The invention is directed to a process of upgrading a sulfur-containing feed fraction boiling the gasoline boiling range which comprises:

contacting the sulfur-containing feed fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

maintaining a second reaction zone comprising a fluidized bed of acidic-functioning catalyst particles in a turbulent reactor bed at a temperature of about 500° to 800° F., said catalyst having an apparent particle density of about 0.9 to 1.6 g/cm$^3$ and a size range of about 1 to 150 microns, an average catalyst particle size of about 20 to 100 microns containing about 10 to 25 weight percent of fine particles having a particle size less than 32 microns;

contacting at least the gasoline boiling range portion of the intermediate product and an aromatics-rich feedstock;

passing said intermediate and aromatics-rich feedstock upwardly through the second reaction zone under turbulent flow conditions at reaction conditions sufficient to convert the intermediate to a product comprising a fraction boiling in the gasoline boiling range having a higher octane number than the gasoline boiling range fraction of the intermediate product;

maintaining turbulent fluidized bed conditions through the reactor bed between transition velocity and transport velocity at a superficial fluid velocity of about 0.3 to 2 meters per second; and recovering a gasoline boiling range hydrocarbon product containing $C_5$+ hydrocarbons and $C_7$ to $C_{11}$ aromatic hydrocarbons.

A light olefin or light cofeed FCC naphtha can be introduced into either reaction zone, preferably the second reaction zone.

A feature of the process is the further reduction in the sulfur content of the hydrotreated gasoline by partially converting any remaining thiophenes, or any aliphatic mercaptans produced by the reaction of olefins (produced during cracking of the $C_6$ to $C_7$ paraffins) and $H_2S$ to $H_2S$ and hydrocarbons. The conditions in the octane restoring zone favor cracking of low octane paraffins resulting in production of higher octane olefins and high octane alkylated aromatics. The octane restoring stage is conducted in the absence of added hydrogen such that this valuable refinery commodity can be separated from the hydrodesulfurized intermediate and recycled back to the hydrodesulfurization zone.

DETAILED DESCRIPTION

Feed

Figure 1:
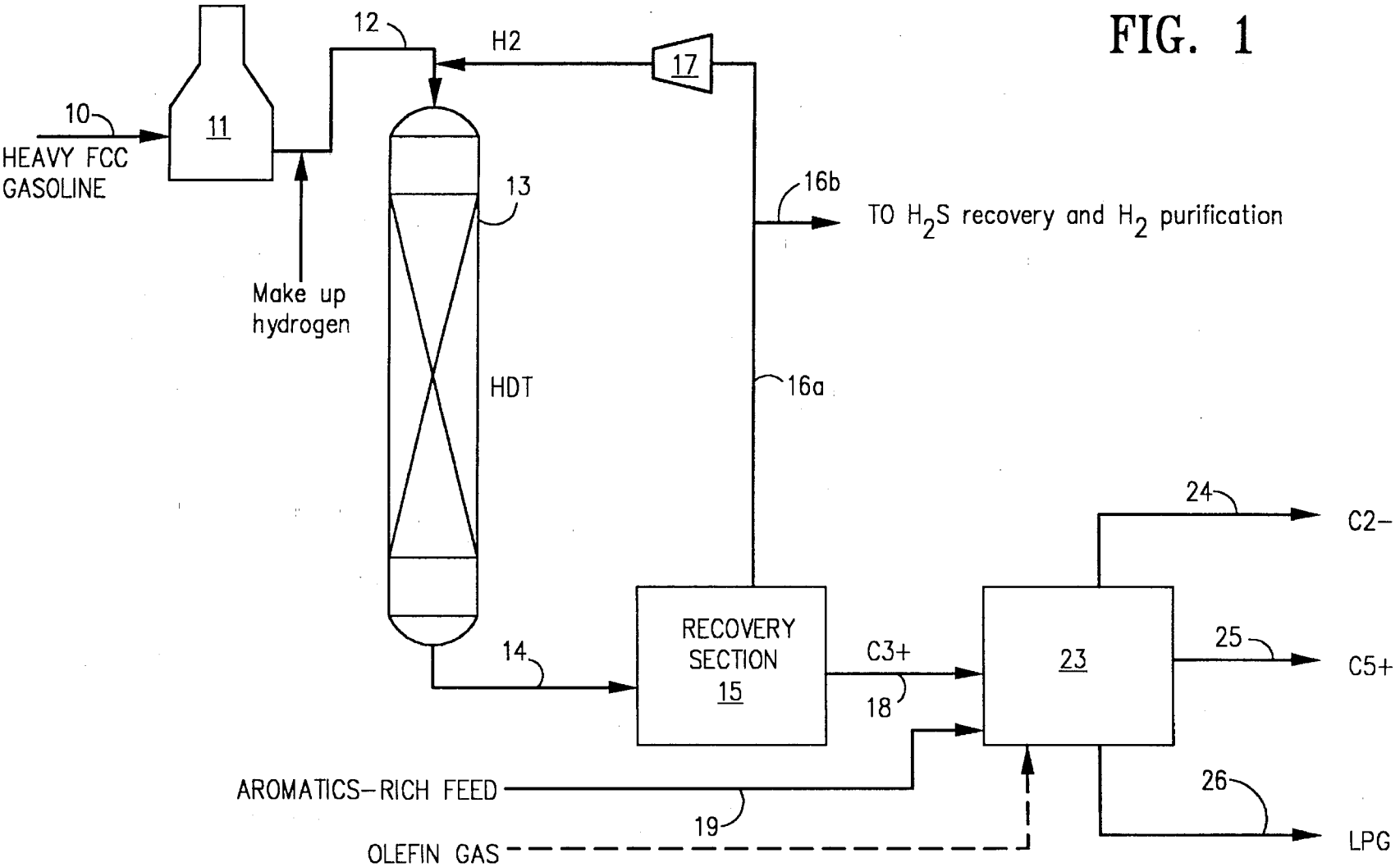
FIG. 1 is a simplified schematic diagram of an embodiment of the integrated hydrodesulfurization and octane restoring process of the instant invention.

The feed to the hydrodesulfurization stage comprises a sulfur-containing gasoline boiling range fraction which, after hydrodesulfurization is introduced to the octane restoring stage along with an aromatics-rich cofeed. Optionally, a light olefin gas stream or a light fraction of sulfur-containing gasoline (i.e. a light FCC naphtha) is cofed to the octane restoring stage.

Gasoline Boiling Range Fraction

The feed to the hydrodesulfurization stage comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F.(163° C) and preferably at least about 350° F.(177° C.), for example, 95 percent points of at least 380° F. (about 193° C.) or at least about 400° F. (about 220° C.).

Although an FCC naphtha is a typical feed for the hydrodesulfurization reaction zone, other suitable hydrocarbon sources include coker gasoline and light straight run naphtha.

The process may be operated with the entire gasoline fraction obtained from the catalytic cracking stage or, alternatively, with part of it. Because the sulfur tends to be concentrated in the higher boiling fractions, it is preferable, particularly when unit capacity is limited, to separate the higher boiling fractions and process them through the stages of the present process without processing the lower boiling cut. Processing the lower boiling cut in the octane restoring zone may be beneficial for purpose of achieving reduced olefins, increased benzene conversion and partial desulfurization. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the stages of the present process, the feed to the hydrodesulfurization stage will be olefinic, with an olefin content of at least 5 and more typically in the range of 10 to 20, e.g. 15–20, weight percent. The properties of a naphtha feed are described in more detail below in Table 1:

TABLE 1

| | Naphtha Feed | | |
|---|---|---|---|
| | Full-range or light | Inter-mediate | Heavy |
| Specific Gravity | 0.74 to 0.80 | 0.80 to 0.85 | 0.85 to 0.95 |
| Hydrogen, wt. % | 11 to 15 | 11 to 14 | 9 to 12 |
| Sulfur, wt. % | 0.0050 to .3000 | 0.05 to 0.60 | 0.1 to 3.0 |
| Nitrogen, ppmw | 5 to 100 | 10 to 150 | 20 to 300 |
| Clear Research Octane R + O | 85 to 95 | 85 to 95 | 88 to 98 |

TABLE 1-continued

| | Naphtha Feed | | |
|---|---|---|---|
| | Full-range or light | Inter-mediate | Heavy |
| Composition, wt. % | | | |
| Paraffins | 5 to 40 | 10 to 30 | 5 to 20 |
| $C_5$ | 0 to 10 | 0 to 5 | 0 to 2 |
| $C_6$ | 1 to 10 | 0 to 5 | 0 to 2 |
| $C_7$ | 2 to 10 | 0 to 5 | 0 to 2 |
| Cycloparaffins | 5 to 30 | 2 to 20 | 2 to 20 |
| Olefins and Diolefins | 5 to 50 | 5 to 40 | 5 to 20 |
| $C_5$ | 0 to 15 | 0 to 5 | 0 to 2 |
| $C_6$ | 1 to 10 | 0 to 5 | 0 to 2 |
| $C_7$ | 1 to 10 | 0 to 15 | 0 to 2 |
| Aromatics | 10 to 50 | 20 to 70 | 30 to 90 |

Benzene-Rich Fraction

The benzene rich fraction, typically a catalytic reformate feedstock, contains $C_6$ to $C_8$ aromatic hydrocarbons and $C_5$ to $C_7$ paraffinic hydrocarbons. The $C_6$ to $C_8$ aromatic hydrocarbons include benzene, toluene, xylene and ethyl benzene. The xylene and ethyl benzene are herein considered together as $C_8$ aromatic hydrocarbons. Though the catalytic reformate is a preferred feedstock, hydrocarbon process streams containing essentially the same hydrocarbon components can also be used. The catalytic reformate feedstock is described in more detail below in Table 2.

TABLE 2

| | Broad | Intermediate | Narrow |
|---|---|---|---|
| Specific Gravity | 0.72 to 0.88 | 0.76 to 0.88 | 0.76 to 0.83 |
| Boiling Range, °F. | 60 to 400 | 60 to 390 | 80 to 300 |
| Mole % | | | |
| Benzene | 1.0 to 60 | 2 to 40 | 5 to 40 |
| Toluene | 0 to 60 | 0 to 40 | 0 to 20 |
| $C_8$ Aromatic[1] | 0 to 60 | 0 to 50 | 0 to 20 |
| Wt. % | | | |
| Benzene | 1.0 to 60 | 2 to 40 | 5 to 40 |
| Toluene | 0 to 60 | 0 to 40 | 0 to 20 |
| $C_8$ Aromatic[1] | 0 to 60 | 0 to 50 | 0 to 20 |
| $C_6$ to $C_8$ Aromatics | 5 to 100 | 10 to 95 | 15 to 95 |

[1]Xylene and ethyl benzene component.

Optional Cofeed

A light olefin gas can be introduced to the fluidized catalyst bed as a cofeed along with the hydrotreated intermediate product and the aromatics-rich fraction. A typical light olefin gas feedstock contains $C_2$ to $C_4$ alkenes (monoolefins) including at least 2 moles % ethene, wherein the total $C_2$–$C_3$ alkenes are in the range of 10 to 40 wt. %. Non-deleterious components, such as methane, $C_3$–$C_4$ paraffins and inert gases, may be present. Some of the paraffins will be converted to $C_4$+ hydrocarbons depending on the reaction conditions and catalyst employed. A particularly useful feedstock is a light gas by-product of FCC gas oil cracking units containing typically 10–40 mol % $C_2$–$C_3$ olefins and 5–35 mol % $H_2$ with varying amounts of $C_1$–$C_3$ paraffins and inert gas, such as $N_2$. The feedstock can contain primarily ethene or ethene and propene.

The light olefin feed gas is described in more detail in the following Table 3.

TABLE 3

| | Broad | Intermediate | Preferred |
|---|---|---|---|
| Mole % | | | |
| $H_2$ | 0 to 50 | 5 to 50 | 5 to 30 |
| Ethene | 1 to 90 | 5 to 40 | 5 to 25 |
| Propene | 0 to 90 | 1 to 40 | 1 to 25 |
| Weight % | | | |
| $H_2$ | 0 to 10 | 1 to 10 | 1 to 4 |
| Ethene | 1 to 90 | 8 to 50 | 8 to 35 |
| Propene | 0 to 90 | 3 to 50 | 3 to 40 |
| Ethene/Propene | 1 to 90 | 5 to 80 | 5 to 60 |

Hydrocarbon Products

The contacting of the hydrotreated intermediate and the aromatics-rich fraction over the zeolite catalyst in accordance with the present invention results in a gasoline boiling range feed of good octane value. The $C_5$ to $C_{13}$ paraffins and naphthenes in the combined feed are cracked in the turbulent fluidized catalyst bed reactor to produce light olefins. The light olefins, typically ethene and propene, react to produce primarily $C_5$ to $C_9$ olefinic, $C_5$to $C_9$ paraffinic and $C_6$ to $C_{10}$ aromatic gasoline products which together have a higher octane number than the hydrotreated intermediate and a higher product value than the ethene and propene.

The ethene and propene also react with the $C_6$ to $C_8$ aromatics in the aromatics-rich stream to produce primarily $C_7$ to $C_{11}$ aromatics which may themselves rearrange and transalkylate over the zeolite catalyst. The $C_7$ to $C_{11}$ aromatic hydrocarbon product obtained includes $C_1$ to $C_4$ lower alkyl substituted aromatic hydrocarbons such as methyl, ethyl, propyl and butyl benzene compounds. The $C_7$ to $C_{11}$ aromatic hydrocarbon product contains one or more of the foregoing lower alkyl substituents, usually, the total numbers of carbon atoms in the substituents does not exceed 5. Typical $C_7$ to $C_{11}$ aromatic hydrocarbons include toluene, xylene, ethyl benzene, methyl ethyl benzene, propyl benzene, methyl propyl benzene, butyl benzene, methyl butyl benzene and diethyl benzene. This series of reactions enriches the overall octane quality of the gasoline product obtained.

The zeolite catalyst process conditions of temperature and pressure in the turbulent regime of the fluidized bed are closely controlled to encourage cracking of $C_5$ to $C_{13}$ paraffin hydrocarbons which is an important feature of the present invention. Unreacted ethene and propene, and butene, formed in the reaction can be recycled to the zeolite catalyst reactor. The light olefins produced are converted in an amount of 20 to 100, preferably 60 to 100 and more preferably 80 to 100 wt. % of the feed. The $C_6$ to $C_8$ aromatics in the catalytic reformate feed, including benzene, toluene and $C_8$ aromatics, are converted in an amount of 5 to 60, preferably 5 to 50 and more preferably 8 to 35 wt. % of the feed.

The addition of light olefins along with the hydrotreated intermediate and the aromatics-rich stream enhances alkylation of the aromatics and production of gasoline boiling range olefins.

It has been found that the sulfur from thiophenes or aliphatic mercaptans produced from light olefins and $H_2S$ in the hydrotreated intermediate, which are in equilibrium, are converted during the fluidized bed reactions, with the release of $H_2S$.

Process Configuration

The selected sulfur-containing, gasoline boiling range feed is treated in two stages by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

The hydrotreated intermediate product is then treated by contact with the second stage catalyst in a fluidized catalyst bed under conditions which produce a product comprising a fraction which boils in the gasoline boiling range which has a higher octane number than the portion of the hydrotreated intermediate product fed to this second stage. The product from this second stage usually has a boiling range which is not substantially higher than the boiling range of the feed to the hydrotreater, but it is of lower sulfur content while having a comparable or even higher octane rating as the result of the second stage treatment.

FIG. 1 represents a simplified schematic flow diagram of an a specific embodiment of the process of the invention. Referring to FIG. 1, a sulfur-containing petroleum fraction, typically a heavy FCC gasoline is fed through line to heater 11 which elevates the temperature of the feed to about 400° to 850° F. (220° to 454° C.), specifically about 500° to 800° F. (260° to 427° C.). The heated feed together with makeup hydrogen is introduced via line 12 to hydrotreater 13 wherein the hydrodesulfurization reactions occur. The hydrodesulfurized intermediate is withdrawn via line 14 and passed through $H_2$ recovery zone 15. The hydrogen is separated from the intermediate and recycled to the hydrotreater 13 via line 16*a*. The hydrotreated intermediate, typically $C_3$+ hydrocarbons, together with an aromatics-rich feed and, optionally, a light olefin gas or light FCC naphtha, are fed to the turbulent regime fluidized bed catalyst zone 23 for octane restoring reactions. Therein, the paraffins of the intermediate undergo cracking reactions resulting in the production of gasoline boiling range olefins and the aromatics undergo alkylation to produce a gasoline boiling range product which all have a higher octane value than the hydrodesulfurized intermediate. A light gas is withdrawn from the process via line 24 for subsequent processing or recycle. The $C_5$+ gasoline fraction is withdrawn via line 25 and a lighter hydrocarbon fraction is withdrawn via line 26.

Hydrotreating

The temperature of the hydrotreating stage is suitably from about 400° to 850° F. (about 220° to 454° C.), preferably about 500° to 800° F. (about 260° to 427° C.) with the exact selection dependent on the desulfurization desired for a given feed and catalyst.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization stage) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second stage of the process. Normally, the denitrogenation which accompanies the desulfurization will result in an acceptable organic nitrogen content in the feed to the second stage of the process; if it is necessary, however, to increase the denitrogenation in order to obtain a desired level of activity in the second stage, the operating conditions in the first stage may be adjusted accordingly.

The catalyst used in the hydrodesulfurization stage is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania, zirconia or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an up-flow, fixed bed, trickle phase process; an ebullating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the first stage. Although some decrease in volume occurs as the result of the conversion to lower boiling products ($C_5$–), the conversion to $C_5$– products is typically not more than 5 volume percent and usually below 3 volume percent and is normally compensated for by the increase which takes place as a result of aromatics saturation. An increase in volume is typical for the second stage of the process where, as the result of cracking the back end of the hydrotreated feed, cracking products within the gasoline boiling range are produced. An overall increase in volume of the gasoline boiling range ($C_5$+) materials may occur.

Octane Restoration Stage

After the hydrotreating stage, the hydrotreated intermediate product is passed to the second stage of the process. In the second stage the hydrotreated intermediate and the aromatics-rich, $C_5$+ hydrocarbon, cofeed are introduced to the fluidized turbulent reaction zone. Prior to the second stage, however, the effluent from the hydrotreating stage may be subjected to an interstage separation/recovery section in which any hydrogen in the product is recovered and recycled to the hydrotreating stage. An interstage separation may also be utilized to remove inorganic sulfur and nitrogen, usually in the form of hydrogen sulfide and ammonia. Alternatively, the intermediate can be introduced directly into the second stage. Some kind of feed-effluent heat exchange may be used in the octane restoration stage.

The hydrotreated intermediate feed along with an aromatics-rich feed, and, optionally, along with a light olefin gas feed, comprising ethene and propene, or light FCC, are contacted over a zeolite catalyst so that the $C_6$ to $C_8$ aromatics, typically in a catalytic reformate, can be converted to higher alkyl aromatic hydrocarbons while at the same time converting the ethene and propene, produced by cracking of the paraffins in the hydrotreated intermediate, to $C_5$+ hydrocarbons. The resulting products are suitable for use as gasoline blending stocks.

In accordance with the present invention it has been found that a low octane hydrotreated gasoline boiling range product can be upgraded to liquid hydrocarbons rich in olefinic gasoline, isobutane and aromatics and that catalytic reformate containing $C_6$ to $C_8$ aromatics can be upgraded to lower alkyl aromatic hydrocarbons of higher octane value by catalytic conversion in a turbulent fluidized bed of solid acid zeolite catalyst under reaction conditions in a single pass or with recycle of gas product. By upgrading the by-product hydrotreated intermediate and the catalytic reformate with light olefin gas, the gasoline yield of FCC units and catalytic reforming units can be significantly increased. Without light olefin feed, gasoline yield is reduced.

Process Conditions

Using a catalyst comprising a zeolite of the topology of ZSM-5 in the second stage octane restoration is carried out at temperatures of 400° to 950° F. (204° to 510° C.), e.g. 500° to 900° F. (260° to 482° C.), preferably 600° to 800° F. (315° to 427° C.).

The temperature conditions in the second stage are relatively higher than temperature conditions maintained in a fluidized bed for a feed which has not been hydrotreated to maximize cracking of the hydrotreated naphtha.

The pressure at which the reaction is carried out is an important parameter of the invention. The process can be carried out at pressures of 50 to 500 psig (445 to 3550 kPa), preferably 100 to 400 psig (790 to 2860 kPa) and more preferably 100–250 psig (790 to 1825 kPa).

The weight hourly space velocity (WHSV) of the hydrotreated intermediate feed and the aromatics-rich feed are also important parameters of the process. The ethene or ethene and propene constituents produced by cracking of the gasoline boiling range fraction, and optionally by addition of a light olefin gas, and the $C_6$ to $C_8$ aromatic constituent of the catalytic reformate and the WHSV are given in terms of these components. The ethene and propene WHSV can be 0.1 to 5.0, preferably 0.1 to 2 and more preferably 0.1 to 1.5. The total hydrocarbon WHSV is about 0.1 to 10.0, preferably 0.2 to 5.0, and more preferably, 0.5 to 4.0.

The $C_5$+ hydrocarbon production and alkyl aromatic production is promoted by those zeolite catalysts having a high concentration of Bronsted acid reaction sites. Accordingly, an important criterion is selecting and maintaining catalyst inventory to provide either fresh catalyst having acid activity or by controlling catalyst deactivation and regeneration rates to provide an apparent average alpha value of about 1 to 80. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980).

The process is a continuous conversion of the hydrotreated low octane gasoline boiling range intermediate and aromatics-rich hydrocarbon containing feedstocks to hydrocarbon products of higher octane value.

In this stage, the feedstock is contacted at elevated temperature with a fluidized bed of zeolite catalyst under conversion conditions. The reactor comprises a fluidized catalyst bed in a vertical reactor column having a turbulent reaction zone. The feedstock is passed upwardly through the reaction zone at a velocity greater than dense bed transition velocity in a turbulent regime and less than transport velocity for the average catalyst particle. A portion of coked catalyst is withdrawn from the reaction zone, oxidatively regenerated and returned to the reaction zone at a rate sufficient to control catalyst activity.

Advantageously, the fluidized bed technique can employ a single pass conversion of normal paraffins of at least 20% to provide a high octane $C_5$+ gasoline range hydrocarbon product in good yield and $C_6$ to $C_8$ aromatic hydrocarbon conversion of at least 5% to provide a higher octane $C_7$ to $C_{11}$ aromatic hydrocarbon gasoline range product in good yield. A mixture of alkenes, alkanes and $C_6$ to $C_8$ aromatics can be converted without significant recycle and/or diluent to provide a high octane gasoline range hydrocarbon product in good yield. Recycle of $C_4$− gas can be used to increase yields further and lower catalyst makeup requirements.

The zeolite catalyst reaction zone is operated under conditions such that the gasoline boiling range stream is converted by reaction with the $C_6$ to $C_8$ aromatics in the reformate feedstream to produce $C_7$ to $C_{11}$ alkyl aromatic hydrocarbons such as toluene, xylene, ethyl benzene, methyl ethyl benzene, diethyl benzene and propyl benzene.

The effluent stream from the zeolite reaction zone is passed into a separator in which a $C_6$− hydrocarbon stream is removed overhead and fed to an absorber in which the $C_3$+ hydrocarbons are absorbed and removed. The remaining $C_3$− hydrocarbons are taken overhead and can be recycled to the turbulent bed reaction zone. The bottoms from the separator contain $C_7$ to $C_{11}$ aromatic hydrocarbons and $C_5$+ hydrocarbons can be fed to a debutanizer from which an overhead $C_4$− gas stream is removed. A portion of the $C_4$− stream can be recycled to the turbulent bed reaction zone. The debutanized gasoline product is removed as a bottoms product and is fed to the gasoline product pool.

Description of Catalysts

Recent developments in zeolite technology have provided a group of medium pore siliceous materials having similar pore geometry. Most prominent among these intermediate pore size zeolites is a crystalline metallosilicate having the topology of zeolite ZSM-5, which is usually synthesized with Bronsted acid active sites by incorporating a tetrahedrally coordinated metal, such as Al, Ga, B or Fe, within the zeolitic framework. These medium pore zeolites are favored for acid catalysis; however, the advantages of ZSM-5 structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 Argauer et al, incorporated by reference.

The zeolite catalysts preferred for use herein include the medium pore (i.e., about 5–7A) shape-selective crystalline aluminosilicate zeolites having a silica-to-alumina ratio of at least 12, a constraint index of about 1 to 12 and acid cracking activity of about 1–200. In the fluidized bed reactor the coked catalyst may have an apparent activity (alpha value) of about 1 to 80 under the process conditions to achieve the required degree of reaction severity. Representative of other suitable zeolites are ZSM-11, ZSM-12, ZSM-22, ZSM-23, ZSM-35 and ZSM-38. ZSM-5 is disclosed in U.S. Pat. No. 3,702,886 and U.S. Pat. No. Reissue 29,948. The ZSM-5 and ZSM-12 catalyst are preferred. Other suitable zeolites are disclosed in U.S. Pat. Nos. 3,709,979, 3,832,449, 4,076,979, 3,832,449, 4,076,842, 4,016,245 and 4,046,839, 4,414,423, 4,417,086, 54,517,396 and 4,542,251. The disclosures of these patents are incorporated herein by reference. While suitable zeolites having a coordinated metal oxide to silica molar ratio of 20:1 to 200:1 or higher may be used, it is advantageous to employ a standard ZSM-5 having a silica alumina molar ratio of about 25:1 to 70:1, suitably modified. A typical zeolite catalyst component having Bronsted acid sites may consist essentially of aluminosilicate ZSM-5 zeolite with 5 to 95 wt. % silica and/or alumina binder.

Certain of the ZSM-5 type medium pore shape selective catalysts are sometimes known as pentasils. In addition to the preferred aluminosilicates, the borosilicate, ferrosilicate and "silicalite" materials may be employed. It is advantageous to employ a standard ZSM-5 having a silica:alumina molar ratio of 25:1 to 70:1 with an apparent alpha value of 1–80 to convert 60 to 100 percent, preferably at least 70%, of the olefins in the feedstock and to convert 1 to 50% preferably at least 5% of the C6 to C8 aromatics in the feedstock.

ZSM-5 type pentasil zeolites are particularly useful in the process because of their regenerability, long life and stability under the extreme conditions of operation. Usually the zeolite crystals have a crystal size from about 0.01 to over 2 microns or more, with 0.02–1 micron being preferred. In order to obtain the desired particle size for fluidization in the turbulent regime, the zeolite catalyst crystals are bound with a suitable inorganic oxide, such as silica, alumina, etc. to provide a zeolite concentration of about 5 to 95 wt. %. A preferred catalyst comprises 25 to 35% H-ZSM-5 catalyst contained within a silica-alumina matrix binder and having a fresh alpha value of less than 80.

Particle size distribution can be a significant factor in achieving overall homogeneity in turbulent regime fluidization. It is desired to operate the process with particles that will mix well throughout the bed. Large particles having a particle size greater than 250 microns should be avoided, and it is advantageous to employ a particle size range consisting essentially of 1 to 150 microns. Average particle size is usually about 20 to 100 microns, preferably 40 to 80 microns. Particle distribution may be enhanced by having a mixture of larger and smaller particles within the operative range, and it is particularly desirable to have a significant amount of fines. Close control of distribution can be maintained to keep about 10 to 25 wt. % of the total catalyst in the reaction zone in the size range less than 32 microns. This class of fluidizable particles is classified as Geldart Group A. Accordingly, the turbulent fluidization regime is controlled to assure operation between the transition velocity and transport velocity. Fluidization conditions are substantially different from those found in non-turbulent dense beds or transport beds.

The Fluidized Catalyst Bed Reactor

The use of the turbulent regime fluidized bed catalyst process permits the conversion system to be operated at low pressure drop. An important advantage of the process is the close temperature control that is made possible by turbulent regime operation, wherein the uniformity of conversion temperature can be maintained within close tolerances, often less than 25° C. Except for a small zone adjacent the bottom gas inlet, the midpoint measurement is representative of the entire bed, due to the thorough mixing achieved.

In a typical process, the hydrotreated intermediate and aromatics-rich feedstock are converted in a catalytic reactor under 600° to 800° F. (260° to 427° C.) temperature and moderate pressure 100 to 250 psig (i.e. 790 to 1825 kPa) to produce a predominantly liquid product consisting essentially of $C_5$+ aliphatic hydrocarbons rich in gasoline-range olefins and $C_7$ to $C_{11}$ alkyl aromatic hydrocarbons.

Figure 2:
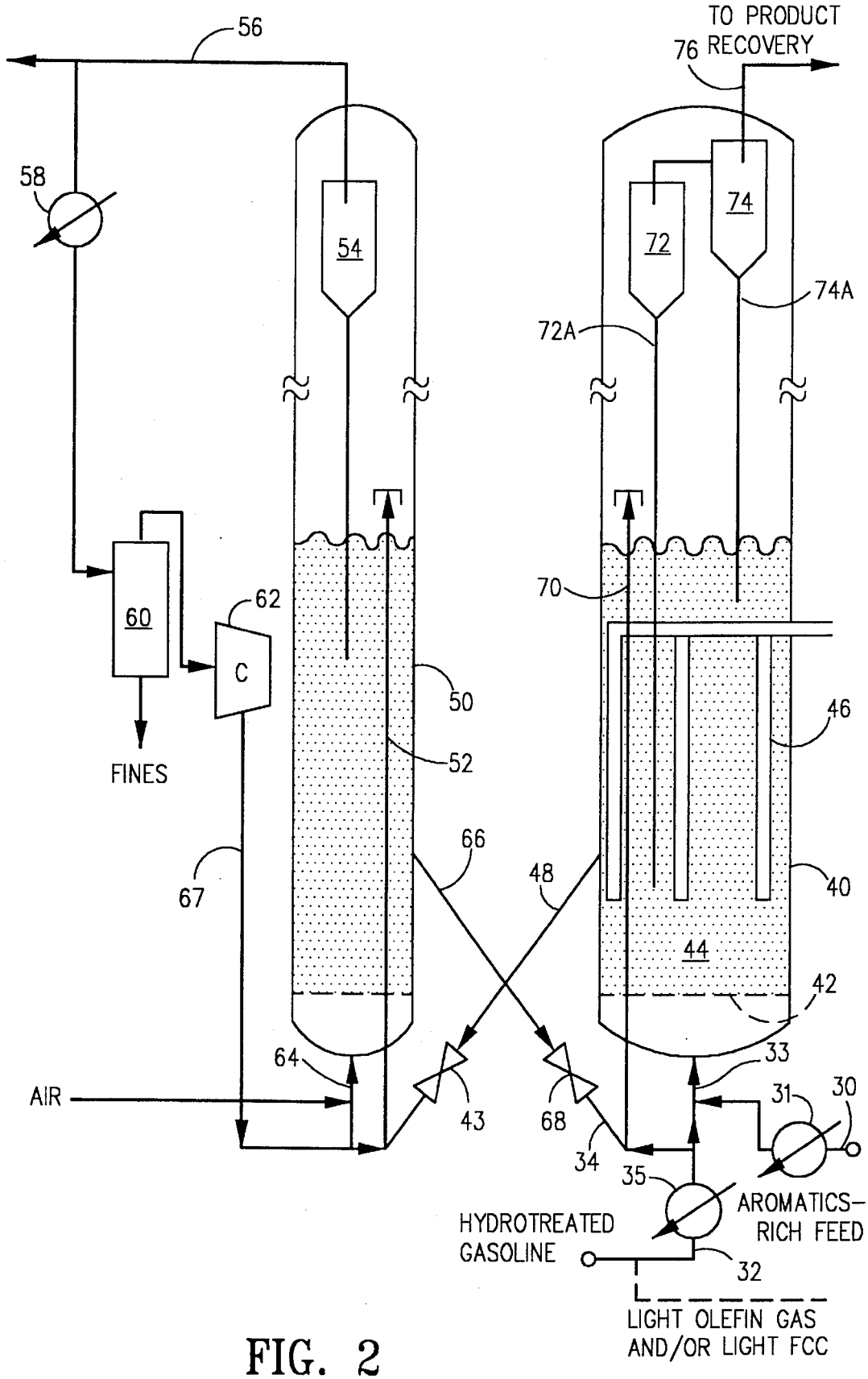
FIG. 2 is a simplified drawing of an embodiment of the turbulent zone of a fluidized bed and the regeneration and recycle of the catalyst.

Referring to FIG. 2 for a description of the fluidized catalyst bed, the hydrotreated intermediate feedstream is fed through line 32 and heated in heat exchanger 35 and then fed to line 33. A pressurized reformate feed rich in $C_6$–$C_8$ aromatic hydrocarbons is fed through line 30 and heated in heat exchanger 31 and then fed to line 33 wherein it is contacted and mixed with heated intermediate, and optionally a light olefin gas and/or a light FCC naphtha introduced via line 32. A major portion of the hydrotreated intermediate feed is mixed in line 33 with the aromatics-rich feed and fed through line 33 to the inlet of reactor vessel 40 for distribution through grid plate 42 into fluidization zone 44. Here the intermediate and $C_6$ to $C_8$ aromatics-rich hydrocarbon feed contact the turbulent bed of finely divided catalyst particles. The intermediate or a light olefin gas will function as a lift gas for the regenerated catalyst.

The heat of reaction can be partially or completely removed by using cold or only partially preheated intermediate and aromatics-rich feeds. Baffles may be added to the reactor vessel to control radial and axial mixing. Heat released from the reaction can be controlled by adjusting feed temperature in a known manner. Catalyst outlet means 48 is provided for withdrawing catalyst from bed 44 and passed for catalyst regeneration in vessel 50 via control valve 49. The outlet means 48 may include a steam stripping section, not shown, in which useful hydrocarbons are removed from the catalyst prior to regeneration of the catalyst.

The partially deactivated catalyst is oxidatively regenerated by controlled contact with air or other regeneration gas at elevated temperature in a fluidized regeneration zone 50 to remove carbonaceous deposits and restore catalyst activity. The catalyst particles are entrained in a lift gas provided via line 67 and transported via riser tube 52 to a top portion of vessel 50. Air is distributed at the bottom of the bed via line 64 to effect fluidization, with oxidation byproducts being carried out of the regeneration zone through cyclone separator 54, which returns any entrained solids to the bed.

Flue gas is withdrawn via top conduit 56 for disposal; however, a portion of the flue gas may be recirculated via heat exchanger 58, separator 60, and compressor 62 for return to the vessel through line 67 with fresh oxidation gas fed via line 64 and as fluidizing gas for the regenerator 50 and as lift gas for the catalyst in riser 52.

Regenerated catalyst is passed to the main reactor 40 through conduit 66 provided with flow control valve 68. The regenerated catalyst may be lifted to the catalyst bed through return riser conduit 70 with pressurized feed gas fed through line 34 to catalyst return riser conduit 70. Since the amount of regenerated catalyst passed to the reactor is relatively small, the temperature of the regenerated catalyst does not upset the temperature constraints of the reactor operations to any significant degree. A series of sequentially connected cyclone separators 72, 74 are provided with diplegs 72A, 74A to return any entrained catalyst fines to the lower bed. These separators are positioned in an upper portion of the reactor vessel comprising dispersed catalyst phase. Filters, such as sintered metal plate filters, can be used alone or in conjunction with cyclones.

The hydrocarbon product effluent separated from catalyst particles in the cyclone separating system is then withdrawn from the reactor vessel 40 through top gas outlet means 76.

A description of the fluidized catalyst bed will also be found in U.S. Pat. No. 4,827,069.

The recovered hydrocarbon product comprising $C_5$+ olefins, aromatics, paraffins, alkyl aromatics and naphthenes is thereafter processed as required to provide the desired gasoline product.

Under optimized process conditions, the turbulent bed has a superficial vapor velocity of about 0.3 to 2 meters per second (m/sec). At higher velocities entrainment of fine particles may become excessive and beyond about 3 m/sec the entire bed may be transported out of the reaction zone. At lower velocities, the formation of large bubbles or gas voids can be detrimental to conversion. Even fine particles cannot be maintained effectively in a turbulent bed below about 0.1 m/sec. A convenient measure of turbulent fluidization is the bed density. A typical turbulent bed has an operating density of about 100 to 500 kg/m$^3$, preferably about 300 to 500 kg/m$^3$, measured at the bottom of the reaction less dense toward the top of the reaction zone, due to pressure particle size differentiation. This density is generally between the catalyst concentration employed in dense beds and the dispersed transport systems. Pressure differential between two vertically spaced points in the reactor column can be measured to obtain the average bed density at such portion of the reaction zone. For instance, in a fluidized bed system employing ZSM-5 particles having an apparent packed density of 750 kg/m$^3$ and real density of 2430 kg/m$^3$, an average fluidized bed density of about 300 to 500 kg/m$^3$ is satisfactory.

By virtue of the turbulence experienced in the turbulent regime, there is excellent gas-solid contact in the catalytic reactor which provides substantially complete conversion, enhanced selectivity and temperature uniformity. One main advantage of this technique is the inherent control of bubble size and characteristic bubble lifetime. Bubbles of the gaseous reaction mixture are small, random and short-lived, thus resulting in good contact between the gaseous reactants and the solid catalyst particles. important feature of this process is that operation in the turbulent fluidization regime is optimized to produce high octane $C_5$+ aliphatic hydrocarbon liquid in good yield from the hydrotreated intermediate and to produce high octane $C_7$ to $C_{11}$ hydrocarbon product in good yield from the aromatics-rich feed.

The zeolite catalyst process conditions, including temperature and pressure, in the turbulent regime of the fluidized bed are closely controlled to crack the hydrotreated paraffinic hydrocarbons in the intermediate feed while minimizing the production of $C_2$– hydrocarbons which is an important feature of the present invention. The weight hourly space velocity and uniform contact provides a close control of contact time between vapor or vapor and liquid and solid phases, typically about 3 to 25 seconds. Another advantage of operating in such a mode is the control of bubble size and life span, thus avoiding large scale gas by-passing in the reactor.

As the superficial gas velocity is increased in the dense bed, eventually slugging conditions occur and with a further increase in the superficial gas velocity the slug flow breaks down into a turbulent regime. The transition velocity at which this turbulent regime occurs appears to decrease with particle size. The turbulent regime extends from the transition velocity to the so-called transport velocity, as described by Avidan et al in U.S. Pat. No. 4,547,616, incorporated herein by reference. As the transport velocity is approached, there is a sharp increase in the rate of particle carryover, and in the absence of solid recycle, the bed could empty quickly.

Several useful parameters contribute to fluidization in the turbulent regime in accordance with the process of the present invention. When employing a ZSM-5 type zeolite catalyst in fine powder form, such a catalyst should comprise the zeolite suitably bound or impregnated on a suitable support with a solid density (weight of a representative individual particle divided by its apparent "outside" volume) in the range from 0.6–2 g/cc, preferably 0.9–1.6 g/cc. The catalyst particles can be in a wide range of particle sizes up to about 250 microns, with an average particle size between about 20 and 100 microns, preferably in the range of 10–150 microns and with the average particle size between 40 and 80 microns. When these solid particles are placed in a fluidized bed where the superficial fluid velocity is 0.3–2 m/sec, operation in the turbulent regime is obtained. The velocity specified here is for an operation at a total reactor pressure of about 0 to 30 psig (100 to 300 kPa). Those skilled in the art will appreciate that at higher pressures, a lower gas velocity may be employed to ensure operation in the turbulent fluidization regime. The reactor can assume any technically feasible configuration, but several important criteria should be considered. The bed of catalyst in the reactor can be at least about 5–20 meters in height. Fine particles may be included in the bed, especially due to attrition, and the fines may be entrained in the product gas stream. A typical turbulent bed may have a catalyst carryover rate up to about 1.5 times the reaction zone inventory per hour. If the fraction of fines becomes large, a portion of the carryover can be removed from the system and replaced by larger particles. It is feasible to have a fine particle separator, such as a cyclone and/or filter means, disposed within or outside the reactor shell to recover catalyst carryover and return this fraction continuously to the bottom of the reaction zone for recirculation at a rate of about one catalyst inventory per hour. Optionally, fine particles carried from the reactor vessel entrained with effluent gas can be recovered by a high operating temperature sintered metal filter.

Reactor Operation

A typical reactor unit employs a temperature-controlled catalyst zone with indirect heat exchange and/or adjustable gas quench, whereby the reaction temperature can be carefully controlled within an operating range of about 500° to 900° F. (204° to 482° C.), preferably at average reactor temperature of 600° to 800° F. (316° to 427° C.). The reaction temperature can be in part controlled by exchanging hot reactor effluent with feedstock and/or recycle streams. Optional heat exchangers may recover heat from the effluent stream prior to fractionation. Part or all of the reaction heat can be removed from the reactor by using cold feed, whereby reactor temperature can be controlled by adjusting feed temperature. The reactor is operated at moderate pressure of about 50 to 500 psig (445 to 3550 kPa), preferably 100 to 250 psig (790 to 1825 kPa). The weight hourly space velocity (WHSV), based on olefins in the fresh feedstock is about 0.1–5 WHSV and the weight hourly space velocity (WHSV) based on total hydrocarbons is 0.1 to 10.0 WHSV.

Typical product fractionation systems that can be used are described in U.S. Pat. No. 4,456,779 and U.S. Pat. No. 4,504,693 (Owen et al).

What is claimed is:

1. A process of upgrading a sulfur-containing catalytically cracked fraction having at least 95% point of at least about 325° F. and boiling in the gasoline boiling range which comprises:

contacting the sulfur-containing catalytically cracked fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number and increased paraffins as compared to the feed;

maintaining a second reaction zone comprising a fluidized bed of acidic-functioning catalyst particles in a turbulent reactor bed at a temperature of about 500° to 900° F., said catalyst having an apparent particle density of about 0.9 to 1.6 g/cm$^3$ and a size range of about 1 to 150 microns, an average catalyst particle size of about 20 to 100 microns containing about 10 to 25 weight percent of fine particles having a particle size less than 32 microns;

co-contacting an aromatics-rich feedstock which contains benzene with the catalytically cracked fraction in the first reaction zone or at least the gasoline boiling range portion of the intermediate product;

passing said intermediate and aromatics-rich feedstock upwardly through the second reaction zone under turbulent flow conditions and reaction conditions sufficient to effect cracking of paraffins and alkylation of benzene with at least a portion of the cracked paraffins and to convert the intermediate to a product comprising a fraction boiling in the gasoline boiling range which fraction has a higher octane number than the gasoline boiling range fraction of the intermediate product;

maintaining turbulent fluidized bed conditions through the reactor bed of the second reaction zone between transition velocity and transport velocity at a superficial fluid velocity of about 0.3 to 2 meters per second; and recovering the gasoline boiling range hydrocarbon fraction.

2. The process of claim 1 in which the fluidized bed density is about 100 to 500 kg/m$^3$, measured at the bottom of the bed, and wherein the catalyst comprises a siliceous metallosilicate acid zeolite having the structure of ZSM-5 zeolite.

3. The process of claim 1 in which the aromatics-rich stream is a catalytic reformate comprising about 10 to 95 wt. % $C_6$ to $C_8$ aromatics.

4. The process of claim 1 in which a hydrogen stream is separated from the intermediate product and recycled to the first reaction zone.

5. The process of claim 1 which further comprises passing a light olefinic gas stream through the second reaction zone.

6. The process of claim 1 which further comprises passing a light catalytic cracked naphtha fraction having a boiling range of $C_5$ to 300° F. through the second reaction zone.

7. The process of claim 1 in which the sulfur-containing feed fraction comprises a light naphtha fraction having a boiling range within the range of $C_6$ to 330° F.

8. The process of claim 1 in which said sulfur-containing feed fraction comprises a full range naphtha fraction having a boiling range within the range of $C_5$ to 420° F.

9. The process of claim 1 in which said sulfur-containing feed fraction comprises a heavy naphtha fraction having a boiling range within the range of 300° to 500° F.

10. The process of claim 1 in which said feed fraction comprises a heavy naphtha fraction having a boiling range within the range of 330° to 412° F.

11. The process of claim 1 in which the hydrodesulfurization catalyst comprises a Group VIII and a Group VI metal.

12. A process of upgrading a sulfur-containing feed fraction boiling in the gasoline boiling range which comprises:

hydrodesulfurizing a catalytically cracked, olefinic sulfur-containing gasoline feed having a sulfur content of at least 50 ppmw, an olefin content of at least 5 percent and a 95 percent point of at least 325° F. with a hydrodesulfurization catalyst in a hydrodesulfurization zone, operating under a combination of elevated temperature, elevated pressure and an atmosphere comprising hydrogen, to produce an intermediate product comprising a normally liquid fraction which has a reduced sulfur content and a reduced octane number as compared to the feed;

maintaining a fluidized catalyst bed in a second reaction zone vertical reactor column having a turbulent reaction zone by passing the intermediate product and a reformate feedstock gas upwardly through the reaction zone at a velocity greater than dense bed transition velocity in a turbulent regime and less than transport velocity for the average catalyst particle and under conditions sufficient to effect cracking of paraffins and alkylation of benzene contained in the reformate with at least a portion of the cracked paraffins;

withdrawing a portion of coked catalyst from the reaction zone, oxidatively regenerating the withdrawn catalyst and returning regenerated catalyst to the second reaction zone at a rate to control catalyst activity and;

recovering a hydrocarbon product comprising a gasoline boiling range fraction having a higher octane number than the gasoline boiling range fraction of the intermediate product, the product further comprising $C_5$+ olefinic hydrocarbons and $C_7$ to $C_{11}$ aromatic hydrocarbons.

13. The process of claim 12 in which the superficial feedstock vapor velocity is about 0.3–2 m/sec; the reaction temperature is about 600° to 800° F.; the weight hourly feedstock space velocity (based on olefin equivalent and total reactor catalyst inventory) is about 0.1 to 5 and the weight hourly feedstock space velocity (based on $C_6$ to $C_8$ aromatics equivalent and total reactor catalyst inventory) is about 0.01 to 6.0; and the average fluidized bed density measured at the reaction zone bottom is about 300 to 500 $kg/m^3$.

14. The process of claim 13 in which the catalyst consists essentially of a medium pore pentasil zeolite having an apparent alpha value of about 1 to 80, and average particle size of about 20 to 100 microns, the reactor catalyst inventory includes at least 10 weight percent fine particles having a particle size less than 32 microns.

15. The process of claim 14 in which the catalyst particles comprise about 5 to 95 weight percent ZSM-5 zeolite having a crystal size of about 0.02–2 microns.

16. The process of claim 12 in which said reformate contains 10 to 95 wt. % $C_6$ to $C_8$ aromatics.

17. The process of claim 12 in which said sulfur-containing feed fraction comprises a naphtha fraction having a 95 percent point of at least about 380° F.

18. The process of claim 12 in which hydrogen is separated from the intermediate product and recycled to the hydrodesulfurization zone.

19. The process of claim 12 in which the hydrodesulfurization is carried out at a temperature of about 500 to 800° F., a pressure of about 300 to 1000 psig, a space velocity of about 1 to 6 LHSV and a hydrogen to hydrocarbon ratio of about 1000 to 2500 standard cubic feed of hydrogen per barrel of feed.

* * * * *